US009625146B2

(12) United States Patent
Myers et al.

(10) Patent No.: US 9,625,146 B2
(45) Date of Patent: Apr. 18, 2017

(54) SWIRL SLOT RELIEF IN A LIQUID SWIRLER

(71) Applicant: Delavan Inc., West Des Moines, IA (US)

(72) Inventors: Steve Myers, Norwalk, IA (US); Jason Ryon, Carlisle, IA (US); Robert Fogarty, West Des Moines, IA (US)

(73) Assignee: DELAVAN INC., West Des Moines, IA (US)

( * ) Notice: Subject to any disclaimer, the term of this patent is extended or adjusted under 35 U.S.C. 154(b) by 109 days.

(21) Appl. No.: 14/329,507

(22) Filed: Jul. 11, 2014

(65) Prior Publication Data

US 2016/0010855 A1 Jan. 14, 2016

(51) Int. Cl.

| | |
|---|---|
| ***B05B 7/10*** | (2006.01) |
| ***F23D 11/38*** | (2006.01) |
| ***B05B 1/34*** | (2006.01) |
| ***F23D 11/10*** | (2006.01) |
| ***F23D 11/24*** | (2006.01) |
| ***F23R 3/30*** | (2006.01) |

(52) U.S. Cl.

CPC ..... *F23D 11/383* (2013.01); *B05B 1/3447* (2013.01); *B05B 7/10* (2013.01); *F23D 11/107* (2013.01); *F23D 11/24* (2013.01); *F23R 3/30* (2013.01)

(58) Field of Classification Search

CPC ..... F23D 11/383; F23D 11/107; F23D 11/24; B05B 1/3447; B05B 7/10; B05B 1/3405; F23R 3/30

USPC ..... 239/403, 406

See application file for complete search history.

(56) References Cited

U.S. PATENT DOCUMENTS

| | | | | |
|---|---|---|---|---|
| 3,844,484 | A * | 10/1974 | Masai | F23D 11/107 239/404 |
| 3,979,069 | A * | 9/1976 | Garofalo | F23D 11/12 239/400 |
| 5,697,553 | A * | 12/1997 | Stotts | B05B 1/3442 239/406 |
| 6,141,967 | A | 11/2000 | Angel | |
| 6,334,579 | B1 * | 1/2002 | Zarbi | B05B 7/0475 239/405 |
| 6,578,777 | B2 * | 6/2003 | Bui | B05B 7/0475 239/406 |
| 7,220,457 | B2 * | 5/2007 | Anderson | B05B 7/10 239/406 |

(Continued)

FOREIGN PATENT DOCUMENTS

| | | |
|---|---|---|
| EP | 1286111 A2 | 2/2003 |
| WO | 0019146 A2 | 4/2000 |

OTHER PUBLICATIONS

European Search Report for application No. EP15163363.3; Mailing Date Dec. 11, 2015, 7 pages.

*Primary Examiner* — Arthur O Hall
*Assistant Examiner* — Juan C Barrera
(74) *Attorney, Agent, or Firm* — Cantor Colburn LLP

(57) ABSTRACT

A swirler for inducing swirl on a liquid flow includes a swirler body defining a downstream end and an upstream end; a plurality of axial slots on an external surface of the swirler body, each of the plurality of axial slots having a slot entrance and a slot exit; and a slot relief at the slot exit. Each of the plurality of axial slots are helical and configured to impart swirl on the liquid flow as the liquid flow traverses through each of the slots.

9 Claims, 4 Drawing Sheets

(56) References Cited

U.S. PATENT DOCUMENTS

| | | | |
|---|---|---|---|
| 2003/0196440 | A1 | 10/2003 | Steinthorsson |
| 2011/0108636 | A1 | 5/2011 | Wright |
| 2013/0125548 | A1 | 5/2013 | Dutta |

* cited by examiner

SWIRL SLOT RELIEF IN A LIQUID SWIRLER

BACKGROUND

The subject matter disclosed herein relates to injection devices for atomizing liquid and, more particularly, to a swirler that includes swirl slots to impart a swirling motion to dispense atomized liquid for an improved spray pattern.

DESCRIPTION OF RELATED ART

Most fuel injectors, for example, most fuel injectors for gas turbine engines, atomize fuel during engine ignition and combustion sequences using either a higher kinetic energy of a flowing air or gas stream to shatter a low energy fuel sheet into fine droplets, or through the kinetic energy in the fuel compared to relatively lower energy surroundings. After the liquid is atomized, it is then introduced into a combustion chamber. Atomization of fuel is desirable because atomized fuel combusts more quickly, more completely, and more cleanly. Some fuel injectors utilize a high pressure of fuel dispensed through the injector to atomize the fuel. Other fuel injectors employ air assist atomizers to deliver high pressure, high velocity air from an external source through a fuel nozzle, which is then mixed with fuel. An alternative to air assist atomizers are airblast atomizers, including for example, pre-filming type airblast atomizers, and cross-flow type airblast atomizers. Regardless of the type of fuel injector, the liquid circuit is usually an essential component of the fuel injectors for the required process of atomizing and distributing the fuel correctly over a wide range of operating conditions in gas turbine combustors.

BRIEF SUMMARY OF THE INVENTION

According to one embodiment of the invention, a swirler for inducing swirl on a liquid flow includes a swirler body defining a downstream end and an upstream end; a plurality of axial slots on an external surface of the swirler body, each of the plurality of axial slots having a slot entrance and a slot exit; and a slot relief at the slot exit; wherein each of the plurality of axial slots are helical and configured to impart swirl on the liquid flow as the liquid flow traverses through each of the slots.

In addition to one or more of the features described above, or as an alternative, further embodiments could include a slot relief that has a relief angle in a range of about 5 degrees to about 20 degrees.

In addition to one or more of the features described above, or as an alternative, further embodiments could include each of the plurality of axial slots are tapered from the slot entrance to the slot exit.

In addition to one or more of the features described above, or as an alternative, further embodiments could include tapered slots that have a taper angle in a range of about 5 degrees to about 20 degrees.

In addition to one or more of the features described above, or as an alternative, further embodiments could include each of the plurality of axial slots have an increasing width from the slot entrance to the slot exit.

In addition to one or more of the features described above, or as an alternative, further embodiments could include each of the plurality of axial slots comprises a first set of counter-clockwise axial slots and a second set of clockwise axial slots on the external surface of the swirler body.

In addition to one or more of the features described above, or as an alternative, further embodiments could include a first set of counter-clockwise axial slots that have a uniform width from the slot entrance to the slot exit.

In addition to one or more of the features described above, or as an alternative, further embodiments could include a second set of clockwise axial slots that have a slot depth that is tapered from the slot entrance to the slot exit.

In addition to one or more of the features described above, or as an alternative, further embodiments could include a second set of clockwise axial slots that have an increasing width from the slot entrance to the slot exit.

In addition to one or more of the features described above, or as an alternative, further embodiments could include, a nozzle assembly for atomizing a liquid comprising a nozzle body having an internal cavity that is aligned on a longitudinal axis; and a swirler positioned in the internal cavity; the swirler further comprising: a swirler body defining a downstream end and an upstream end; a plurality of axial slots on an external surface of the swirler body, each of the plurality of axial slots having a slot entrance and a slot exit; and a slot relief at the slot exit; wherein each of the plurality of axial slots are helical and configured to impart swirl on the liquid flow as the liquid flow traverses through each of the slots.

In addition to one or more of the features described above, or as an alternative, further embodiments could include each of the plurality of axial slots that are tapered from the slot entrance to the slot exit.

In addition to one or more of the features described above, or as an alternative, further embodiments could include each of the plurality of axial slots that have an increasing width from the slot entrance to the slot exit.

In addition to one or more of the features described above, or as an alternative, further embodiments could include each of the plurality of axial slots further comprises a first set of counter-clockwise axial slots and a second set of clockwise axial slots on the external surface of the swirler body.

In addition to one or more of the features described above, or as an alternative, further embodiments could include a second set of clockwise axial slots that are tapered from the slot entrance to the slot exit.

In addition to one or more of the features described above, or as an alternative, further embodiments could include a second set of clockwise axial slots that have an increasing width from the slot entrance to the slot exit.

The technical function achieved by the one or more embodiments described above includes improved spray quality at narrow spray angles and improved fuel sheeting in air blast fuel swirlers.

Other aspects, features, and techniques of the invention will become more apparent from the following description taken in conjunction with the drawings.

BRIEF DESCRIPTION OF THE SEVERAL VIEWS OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which like elements are numbered alike in the several FIGURES:

DETAILED DESCRIPTION OF THE INVENTION

Figure 1A:
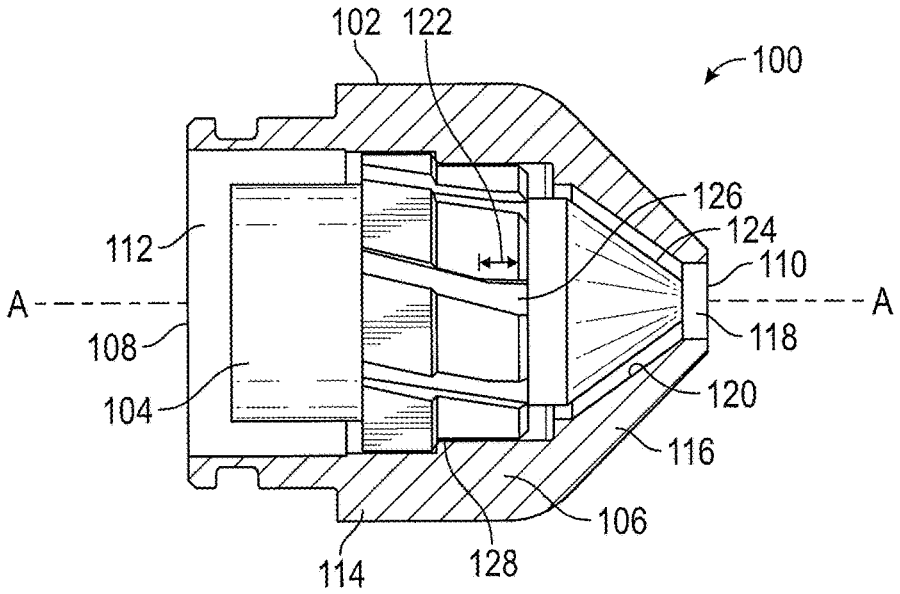
FIG. 1A shows a cross-sectional view of a pressure atomizing nozzle assembly in accordance with an embodiment of the invention.

Referring to FIG. 1A, there is shown an illustrative embodiment of a pressure atomizing nozzle assembly 100 in accordance with an embodiment of the invention. Nozzle assembly 100 includes a nozzle 102 and a slotted fuel swirler 104. Nozzle 102 has a generally tubular nozzle body 106 from an upstream end 108 to a downstream end 110. Nozzle body 106 includes a longitudinal coextensive cavity 112 that is aligned along longitudinal axis A and which is provided to receive swirler 104. Swirler 104 is configured to reside within cavity 112 and be aligned along longitudinal axis A. Further, nozzle body 106 has a generally cylindrical portion 114 that terminates into a generally conical portion 116. Conical portion 116 is generally cone shaped and includes an orifice 118, which provides an egress for an atomized liquid fuel from nozzle assembly 100. Conical portion 116 cooperates with cylindrical portion 114 to provide a swirl chamber 124 that is defined from slot exit 126 to downstream end 110. Conical portion 116 includes an inner surface 120 that is tapered at an angle of about 60 degrees to about 70 degrees. Taper angle of inner surface 120 is configured to establish a narrower spray angle for atomized liquid from nozzle assembly 100. Although nozzle assembly 100 is illustrated and described in the disclosed embodiments with an atomized liquid fuel, it will be appreciated that nozzle assembly 100 can also be used in other applications for providing an atomized spray stream of other liquids (such as oil), in automobile engines and other systems with ignition and combustion chambers, as well as industrial processes that require liquid atomization.

Figure 1B:
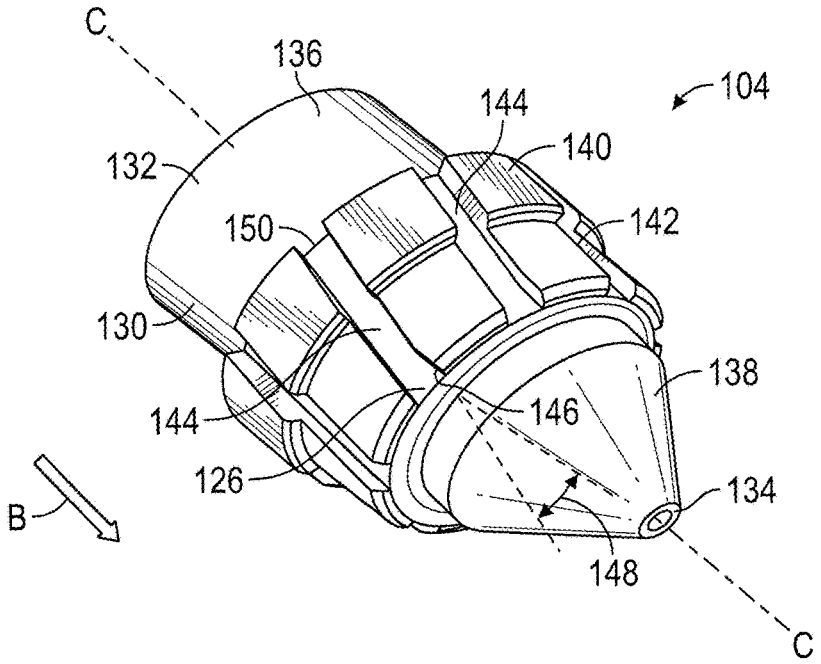
FIG. 1B shows a perspective view of the fuel swirler of FIG. 1A, which is shown with a relief at a downstream end of the swirl slots in accordance with an embodiment of the invention.

Referring to FIG. 1B, swirler 104 has a generally tubular swirler body 130 from upstream end 132 to downstream end 134. Swirler body 130 is a unitary body and includes a generally cylindrical portion 136 that terminates into a conical portion 138. Swirler body 130 is aligned along longitudinal axis C. Moving from upstream end 132 to downstream end 136 in direction of arrow B, cylindrical portion 136 includes a first raised edge 140 that terminates into a second raised edge 142. A plurality of substantially similar and axially spaced helical slots, for example, axially spaced helical slots 144 are provided circumferentially in cylindrical portion 136 and traverse raised edges 140 and 142 to define a slot entrance 150 and a slot exit 126. The axially spaced helical slots 144 are equally spaced apart in the circumferential direction. The helical slots 144 create swirl in the high pressure liquid as the liquid travels through slots 144 from slot entrance 150 to slot exit 126. Helical slots 144 have a generally uniform width from slot entrance 150 to slot exit 126 and include slot relief 146 at each slot exit 126. In an embodiment, slot relief 146 has a relief angle 148 that is between about 5 degrees to about 20 degrees, preferably 7 degrees. Also, as depicted in FIG. 1A, slot relief 146 has a length 122 that comprises about 20 percent of the overall length of the slot 144. As the liquid exits slot exit 126, slot relief 146 is configured to cause the liquid spray to spread out as it egresses slot exit 126 but still maintain a narrow spray angle as it egress orifice 118. Exiting slot exit 126, the atomized liquid spray traverses swirl chamber 124 (FIG. 1A) and contacts inner surface 120 to define a spray angle that is narrower and streak free as it exits orifice 118. Prior art swirlers with helical axial slots do not include a slot relief, which may results in spray slot streaks and wider spray angles as the atomized liquid spray exits the nozzle assembly.

Figure 2A:
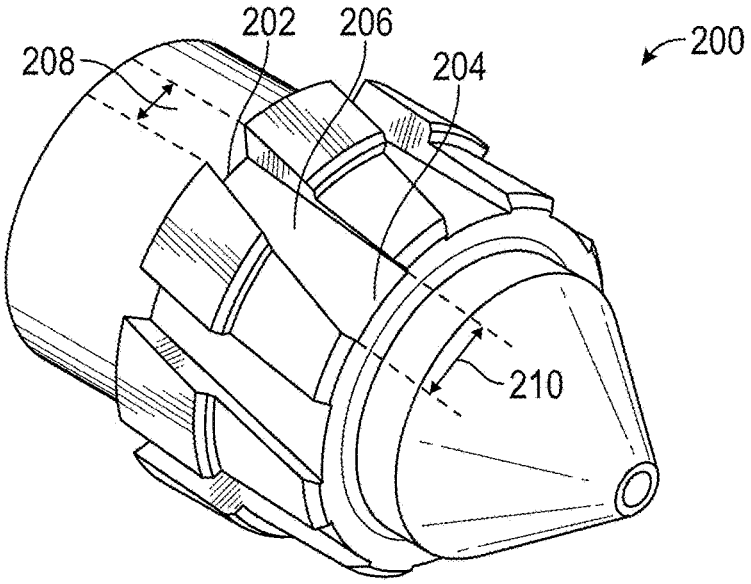
FIG. 2A shows a perspective view of a fuel swirler in accordance with another embodiment of the invention.
Figure 2B:
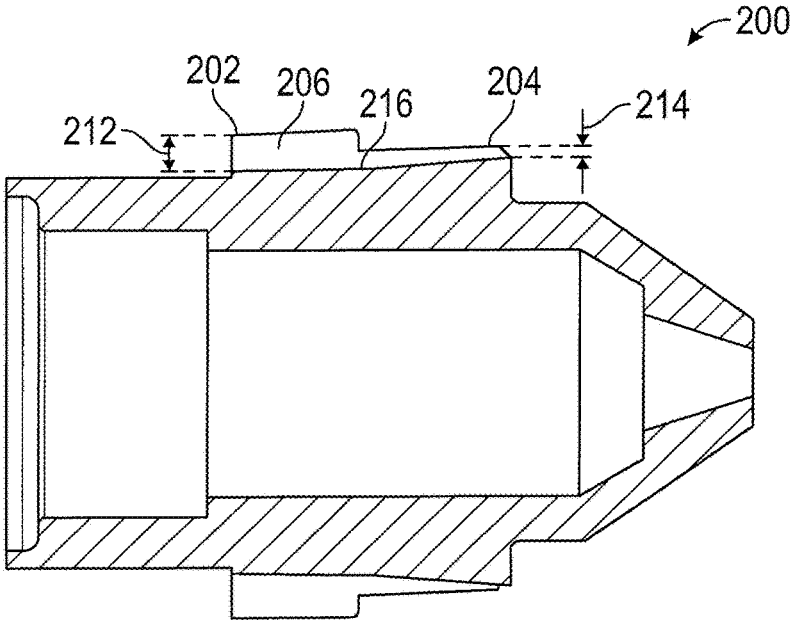
FIG. 2B shows a cross-section view of the fuel swirler of FIG. 2A in accordance with an embodiment of the invention.

Referring to FIGS. 2A and 2B, there is shown another embodiment of an axial-type swirler 200 with non-uniform and tapered slots. Swirler 200 is substantially identical to axial-type swirler 104 of FIGS. 1A and 1B except that slots 206 have a non-uniform width from slot entrance 202 to slot exit 204. Particularly, slot 206 has a width 208, at slot entrance 202, which gradually increases to a width 210 at slot exit 204. Slot exit 204 area shall provide 105-120% of the area provided by metering geometry. Metering geometry area is defined as the area between slot bottom 216 and nozzle body lip radial diameter 128 (FIG. 1A). The non-uniform width for slot 206 provides the same functionality as slot relief 146 of FIGS. 1A-1B except that the functionality of a slot relief in slot 206 extends substantially for the entire length of slot 206. Further, as shown in FIG. 2B, slot 206 is tapered with a depth 212, at slot entrance 202, which gradually decreases to a depth 214 at slot exit 204. In an embodiment, slot 206 has a taper angle that is between about 5 degrees to about 15 degrees. The taper angle provides a larger slot pressure drop at slot entrance 202 than a slot pressure drop at exit for metering geometry area in order to define flow rate of the atomized liquid fuel.

Figure 3A:
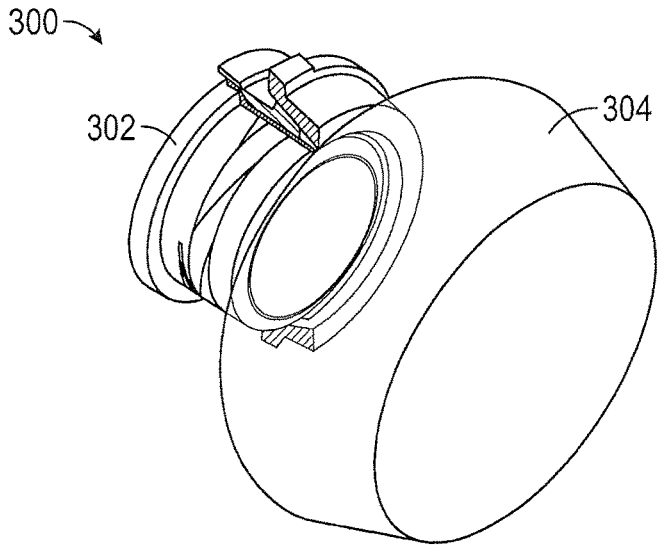
FIG. 3A shows a partial perspective view of an air-blast nozzle assembly in accordance with another embodiment of the invention.
Figure 3B:
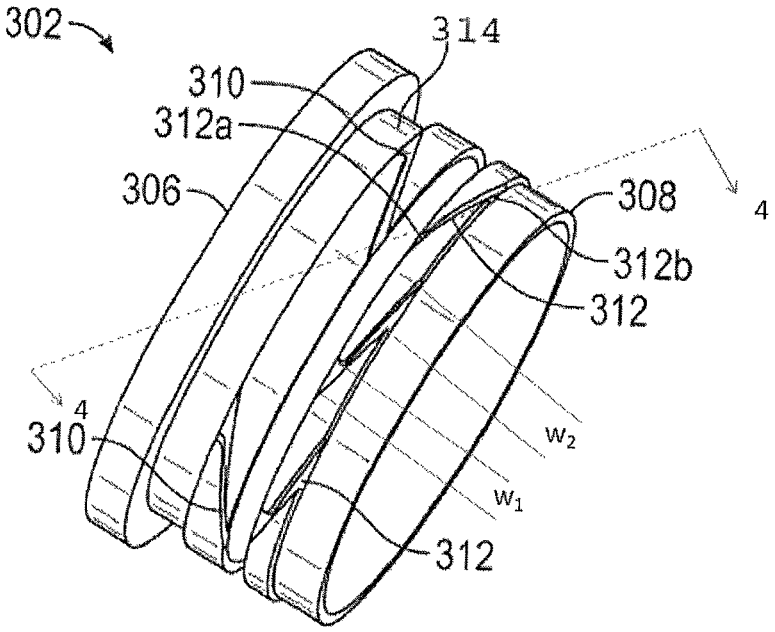
FIG. 3B shows a perspective view of a fuel swirler used in the nozzle assembly of FIG. 3A in accordance with another embodiment of the invention.
Figure 4:
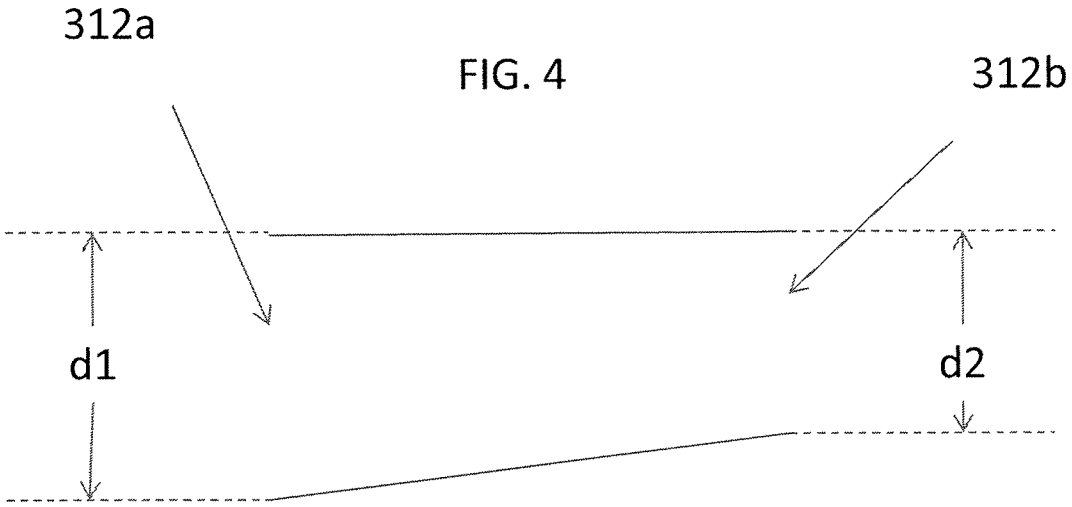
FIG. 4 is a limited cross section of FIG. 3B showing a second swirl slot.

FIGS. 3A and 3B depict an example of an air-blast nozzle assembly 300 with an axial-type swirler 302 according to another embodiment of the invention. Nozzle assembly 300 includes a nozzle 302 and airflow from an air circuit to atomize liquid fuel and provide a more uniform fuel sheet 304. As is shown in FIG. 3B, swirler 302 has a generally tubular swirler body 314 from upstream end 306 to downstream end 308. Body 304 includes a first plurality of substantially similar axially spaced helical slots 310 that are circumferentially located on outer surface of body 304 and a second plurality of substantially similar axially spaced helical slots 312 that are circumferentially located on outer surface of body 304. The first plurality of slots 310 have a counter-clockwise orientation on outer surface of body 304 and include slots that have a uniform width from slot entrance (i.e., proximal to upstream end 306) to slot exit (i.e., proximal to downstream end 308). Further, the second plurality of slots 312 are substantially similar to slots 206 of FIGS. 2A and 2B. Particularly, second plurality of slots 312 have a clockwise orientation on outer surface of body 304, are tapered with a depth that gradually decreases from slot entrance 312*a* (i.e., generally proximal to upstream end 306) to slot exit 312*b* (i.e., generally proximal to downstream end 308), that is, d1>d2 as shown in FIG. 4 and have an increasing width from slot entrance 312*a* to slot exit 312*b*, that it, $w_1<w_2$. The second plurality of slots 312 diffuse with the slot relief similar to the embodiment of FIGS. 2A-2B, and the relief starts from within 10% of the slot inlet 312*a* and persists until the slot exit 312*b*. In embodiments, slots 312 have a taper angle that is between about 5 degrees to 15 degrees with a preferred angle of about 7 degrees. The plurality of helical slots 312 with an increasing slot width configuration provides a more uniform spray sheet than that prior art swirlers.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. For instance, aspects of the invention are not limited to atomizing liquid fuel in gas turbine engines for aircraft, and can be used for atomizing other liquids (such as oil), in automobile engines and other systems with ignition and combustion chambers, as well as industrial processes that require liquid atomization. Many modifications, variations, alterations, substitutions or equivalent arrangement not hereto described will be apparent to those of ordinary skill in the art without departing from the scope and spirit of the invention. Additionally, while the various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A swirler for inducing swirl on a liquid flow, comprising:

a swirler body defining a downstream end and an upstream end;

a plurality of axial slots on an external surface of the swirler body, each of the plurality of axial slots having a slot entrance and a slot exit; and a slot relief at the slot exit;

wherein each of the plurality of axial slots are helical and configured to impart swirl on the liquid flow as the liquid flow traverses through each of the slots;

wherein each of the plurality of axial slots further comprises a first set of counter-clockwise axial slots and a second set of clockwise axial slots on the external surface of the swirler body; and wherein the second set of clockwise axial slots have a slot depth that is tapered from the slot entrance to the slot exit.

2. The swirler of claim 1, wherein the slot relief has a relief angle in a range of about 5 degrees to about 20 degrees.

3. The swirler of claim 1, wherein each of the plurality of axial slots is tapered from the slot entrance to the slot exit.

4. The swirler of claim 3, wherein each of the plurality of axial slots have a taper angle in a range of about 5 degrees to about 20 degrees.

5. The swirler of claim 1, wherein each of the plurality of axial slots has an increasing width from the slot entrance to the slot exit.

6. The swirler of claim 1, wherein the first set of counter-clockwise axial slots have a uniform width from the slot entrance to the slot exit.

7. A nozzle assembly for atomizing a liquid, comprising:

a nozzle body having an internal cavity that is aligned on a longitudinal axis; and a swirler positioned in the internal cavity; the swirler further comprising:

a swirler body defining a downstream end and an upstream end;

a plurality of axial slots on an external surface of the swirler body, each of the plurality of axial slots having a slot entrance and a slot exit; and a slot relief at the slot exit;

wherein the plurality of axial slots are helical and configured to impart; swirl on the liquid flow as the liquid flow traverses through each of the slots;

wherein each of the plurality of axial slots further comprises a first set of counter-clockwise axial slots and a second set of clockwise axial slots on the external surface of the swirler body; and wherein the second set of clockwise axial slots have an increasing width from the slot entrance to the slot exit.

8. The nozzle assembly of claim 7, wherein each of the plurality of axial slots is tapered from the slot entrance to the slot exit.

9. The nozzle assembly of claim 7, wherein each of the plurality of axial slots has an increasing width from the slot entrance to the slot exit.

* * * * *